US011660721B2

(12) United States Patent
Zuniga et al.

(10) Patent No.: US 11,660,721 B2
(45) Date of Patent: May 30, 2023

(54) DUAL LOADING RETAINING RING

(71) Applicant: Applied Materials, Inc., Santa Clara, CA (US)

(72) Inventors: Steven M. Zuniga, Soquel, CA (US); Andrew Nagengast, Sunnyvale, CA (US)

(73) Assignee: Applied Materials, Inc., Santa Clara, CA (US)

( * ) Notice: Subject to any disclaimer, the term of this patent is extended or adjusted under 35 U.S.C. 154(b) by 276 days.

(21) Appl. No.: 17/178,746

(22) Filed: Feb. 18, 2021

(65) Prior Publication Data

US 2022/0258301 A1 Aug. 18, 2022

(51) Int. Cl.
*B24B 37/32* (2012.01)
*B24B 37/04* (2012.01)

(52) U.S. Cl.
CPC ..... *B24B 37/32* (2013.01); *B24B 37/042* (2013.01)

(58) Field of Classification Search
CPC ..... B24B 37/32; B24B 37/042
USPC ..... 451/59
See application file for complete search history.

(56) References Cited

U.S. PATENT DOCUMENTS 6,220,944 B1 4/2001 Chen
6,623,343 B2 9/2003 Kajiwara et al.
7,121,934 B2 10/2006 Jung
2012/0034849 A1 2/2012 Chen et al.
2013/0102152 A1* 4/2013 Chao ..... B24B 37/32 438/692
2020/0276686 A1 9/2020 Nagengast et al.

FOREIGN PATENT DOCUMENTS

JP 2005-169527 A 6/2005

OTHER PUBLICATIONS

International Search Report dated May 13, 2022 for Application No. PCT/US2022/014538.

* cited by examiner

*Primary Examiner* — Don M Anderson
*Assistant Examiner* — Caleb Andrew Holizna
(74) *Attorney, Agent, or Firm* — Patterson + Sheridan, LLP

(57) ABSTRACT

A substrate carrier configured to be attached to a polishing system for polishing a substrate is described herein. The substrate carrier includes a housing including a plurality of load couplings and a retaining ring coupled to the housing. The retaining ring can include an annular body having a central axis, an inner edge facing the central axis of the annular body, the inner edge having a diameter configured to surround a substrate, and an outer edge opposite the inner edge, wherein the plurality of load couplings contact the retaining ring at different radial distances measured from the central axis, and wherein the plurality of load couplings are configured to apply a radially differential force to the retaining ring.

20 Claims, 9 Drawing Sheets

DUAL LOADING RETAINING RING

BACKGROUND

Field

Embodiments of the present disclosure generally relate to an apparatus and method for polishing and/or planarization of substrates. More particularly, embodiments of the disclosure relate to polishing heads utilized for chemical mechanical polishing (CMP).

Description of the Related Art

Chemical mechanical polishing (CMP) is commonly used in the manufacturing of semiconductor devices to planarize or polish a layer of material deposited on a crystalline silicon (Si) substrate surface. In a typical CMP process, the substrate is retained in a substrate carrier, e.g., polishing head, which presses the back side of the substrate towards a rotating polishing pad in the presence of a polishing fluid. Generally, the polishing fluid comprises an aqueous solution of one or more chemical constituents and nanoscale abrasive particles suspended in the aqueous solution. Material is removed across the material layer surface of the substrate in contact with the polishing pad through a combination of chemical and mechanical activity which is provided by the polishing fluid and the relative motion of the substrate and the polishing pad.

The substrate carrier includes a membrane having a plurality of different radial zones that contact the substrate. Using the different radial zones, pressure applied to a chamber bounded by the backside of the membrane may be selected to control the center to edge profile of force applied by the membrane to the substrate, and consequently, to control the center to edge profile of force applied by the substrate against the polishing pad. The polishing head also includes a retaining ring surrounding the membrane. The retaining ring has a bottom surface for contacting the polishing pad during polishing and a top surface which is secured to the polishing head. Pre-compression of the polishing pad under the bottom surface of the retaining ring reduces a pressure spike at the perimeter portion of the substrate by moving an increased pressure region from underneath the substrate to underneath the retaining ring. Thus, the retaining ring can improve the resulting finish and flatness of the substrate surface.

Even with the different radial zones and use of the retaining ring, a persistent problem with CMP is the occurrence of an edge effect, i.e., the over- or under-polishing of the outermost 5-10 mm of a substrate, which can result from a knife edge effect, where a leading edge of the substrate is scraped along a top surface of the polishing pad. In certain other instances, conventional CMP processes can suffer from undesirably high polishing rates at the edge of the substrate caused by rebound of the polishing pad.

Accordingly, what is needed in the art are apparatus and methods for solving the problems described above.

SUMMARY

Embodiments of the present disclosure generally relate to an apparatus and method for polishing and/or planarization of substrates. More particularly, embodiments of the disclosure relate to polishing heads utilized for chemical mechanical polishing (CMP).

In one embodiment, a substrate carrier is configured to be attached to a polishing system for polishing a substrate. The substrate carrier includes a housing including a plurality of load couplings and a retaining ring coupled to the housing. The retaining ring includes an annular body having a central axis and an inner edge facing the central axis of the annular body. The inner edge has a diameter configured to surround a substrate. The retaining ring includes an outer edge opposite the inner edge. The plurality of load couplings contact the retaining ring at different radial distances measured from the central axis, and the plurality of load couplings are configured to apply a radially differential force to the retaining ring.

In another embodiment, a method for polishing a substrate disposed in a substrate carrier includes moving the substrate carrier relative to a polishing pad. A retaining ring of the substrate carrier contacts the polishing pad during the process of moving the substrate carrier. The method includes, during the process of moving the substrate carrier, applying a radially differential force to the retaining ring using a plurality of radially spaced load couplings.

In yet another embodiment, a polishing system includes a polishing pad and a substrate carrier configured to press a substrate against the polishing pad. The substrate carrier includes a housing including a plurality of load couplings and a retaining ring coupled to the housing. The retaining ring includes an annular body having a central axis and an inner edge facing the central axis of the annular body. The inner edge has a diameter configured to surround a substrate. The retaining ring includes an outer edge opposite the inner edge. The plurality of load couplings contact the retaining ring at different radial distances measured from the central axis, and the plurality of load couplings are configured to apply a radially differential force to the retaining ring.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

Before describing several exemplary embodiments of the apparatus and methods, it is to be understood that the disclosure is not limited to the details of construction or process steps set forth in the following description. It is envisioned that some embodiments of the present disclosure may be combined with other embodiments.

Conventional chemical mechanical polishing (CMP) processes can suffer from undesirably high polishing rates at the edge of the substrate caused by rebound of the polishing pad at the edge of the substrate. However, in one or more embodiments of the present disclosure, a downforce of the retaining ring on the polishing pad can be radially controlled. Radial control of the downforce can mitigate the pad rebound effect thereby improving substrate edge uniformity and profile.

Figure 1A:
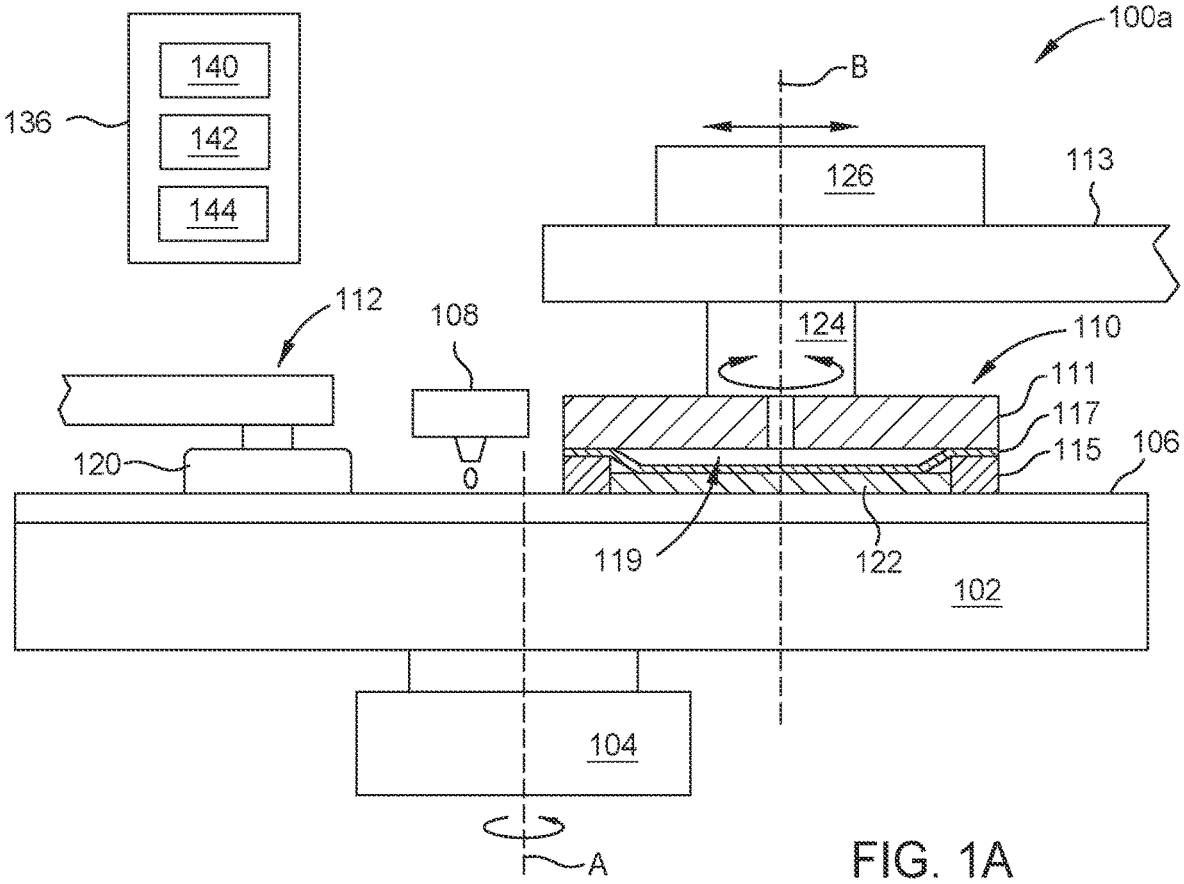
FIG. 1A is a schematic side view of an exemplary polishing station which may be used to practice the methods set forth herein, according to one or more embodiments.
Figure 1B:
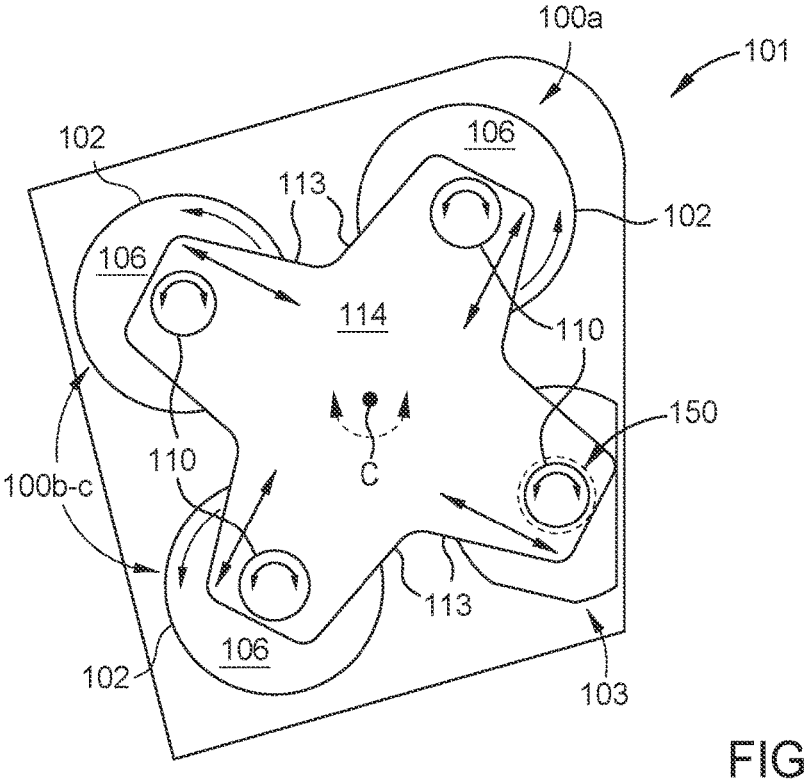
FIG. 1B is a schematic plan view of a portion of a multi-station polishing system which may be used to practice the methods set forth herein, according to one or more embodiments.

FIG. 1A is a schematic side view of a polishing station 100*a*, according to one or more embodiments, which may be used to practice the methods set forth herein. FIG. 1B is a schematic plan view of a portion of a multi-station polishing system 101 comprising a plurality of polishing stations 100*a-c*, where each of the polishing stations 100*b-c* are substantially similar to the polishing station 100*a* described in FIG. 1A. In FIG. 1B at least some of the components with respect to the polishing station 100*a* described in FIG. 1A are not shown on the plurality of polishing stations 100*a-c* in order to reduce visual clutter. Polishing systems that may be adapted to benefit from the present disclosure include REFLEXION® LK and REFLEXION® LK PRIME Planarizing Systems, available from Applied Materials, Inc. of Santa Clara, Calif., among others.

As shown in FIG. 1A, the polishing station 100*a* includes a platen 102, a first actuator 104 coupled to the platen 102, a polishing pad 106 disposed on the platen 102 and secured thereto, a fluid delivery arm 108 disposed over the polishing pad 106, a substrate carrier 110 (shown in cross-section), and a pad conditioner assembly 112. Here, the substrate carrier 110 is suspended from a carriage arm 113 of a carriage assembly 114 (FIG. 1B) so that the substrate carrier 110 is disposed over the polishing pad 106 and faces there towards. The carriage assembly 114 is rotatable about a carriage axis C to move the substrate carrier 110, and thus a substrate 122 chucked therein, between a substrate carrier loading station 103 (FIG. 1B) and/or between polishing stations 100*a-c* of the multi-station polishing system 101. The substrate carrier loading station 103 includes a load cup 150 (shown in phantom) for loading a substrate 122 to the substrate carrier 110.

During substrate polishing, the first actuator 104 is used to rotate the platen 102 about a platen axis A and the substrate carrier 110 is disposed above the platen 102 and faces there towards. The substrate carrier 110 is used to urge a to-be-polished surface of a substrate 122 (shown in phantom), disposed therein, against the polishing surface of the polishing pad 106 while simultaneously rotating about a carrier axis B. Here, the substrate carrier 110 includes a housing 111, an annular retaining ring 115 coupled to the housing 111, and a membrane 117 spanning the inner diameter of the retaining ring 115. The retaining ring 115 surrounds the substrate 122 and prevents the substrate 122 from slipping from the substrate carrier 110 during polishing. The membrane 117 is used to apply a downward force to the substrate 122 and for loading (chucking) the substrate into the substrate carrier 110 during substrate loading operations and/or between substrate polishing stations. For example, during polishing, a pressurized gas is provided to a carrier chamber 119 to exert a downward force on the membrane 117 and thus a downward force on the substrate 122 in contact therewith. Before and after polishing, a vacuum may be applied to the chamber 119 so that the membrane 117 is deflected upwards to create a low pressure pocket between the membrane 117 and the substrate 122, thus vacuum-chucking the substrate 122 into the substrate carrier 110.

The substrate 122 is urged against the pad 106 in the presence of a polishing fluid provided by the fluid delivery arm 108. The rotating substrate carrier 110 oscillates between an inner radius and an outer radius of the platen 102 to, in part, reduce uneven wear of the surface of the polishing pad 106. Here, the substrate carrier 110 is rotated using a first actuator 124 and is oscillated using a second actuator 126.

Here, the pad conditioner assembly 112 comprises a fixed abrasive conditioning disk 120, e.g., a diamond impregnated disk, which may be urged against the polishing pad 106 to rejuvenate the surface thereof and/or to remove polishing byproducts or other debris therefrom. In other embodiments, the pad conditioner assembly 112 may comprise a brush (not shown).

Here, operation of the multi-station polishing system 101 and/or the individual polishing stations 100*a-c* thereof is facilitated by a system controller 136 (FIG. 1A). The system controller 136 includes a programmable central processing unit (CPU 140) which is operable with a memory 142 (e.g., non-volatile memory) and support circuits 144. The support circuits 144 are conventionally coupled to the CPU 140 and comprise cache, clock circuits, input/output subsystems, power supplies, and the like, and combinations thereof coupled to the various components of the polishing system 101, to facilitate control of a substrate polishing process. For example, in some embodiments the CPU 140 is one of any form of general purpose computer processor used in an industrial setting, such as a programmable logic controller (PLC), for controlling various polishing system component and sub-processors. The memory 142, coupled to the CPU 140, is non-transitory including one or more of readily available memory such as random access memory (RAM), read only memory (ROM), floppy disk drive, hard disk, or any other form of digital storage, local or remote.

Herein, the memory 142 is in the form of a computer-readable storage media containing instructions (e.g., non-volatile memory), that when executed by the CPU 140, facilitates the operation of the polishing system 101. The instructions in the memory 142 are in the form of a program product such as a program that implements the methods of the present disclosure (e.g., middleware application, equipment software application etc.). The program code may conform to any one of a number of different programming languages. In one example, the disclosure may be implemented as a program product stored on computer-readable storage media for use with a computer system. The program(s) of the program product define functions of the embodiments (including the methods described herein).

Illustrative computer-readable storage media include, but are not limited to: (i) non-writable storage media (e.g., read-only memory devices within a computer such as CD-ROM disks readable by a CD-ROM drive, flash memory, ROM chips or any type of solid-state non-volatile semiconductor memory) on which information is permanently stored; and (ii) writable storage media (e.g., floppy disks within a diskette drive or hard-disk drive or any type of solid-state random-access semiconductor memory) on which alterable information is stored. Such computer-readable storage media, when carrying computer-readable instructions that direct the functions of the methods described herein, are embodiments of the present disclosure.

Figure 2A:
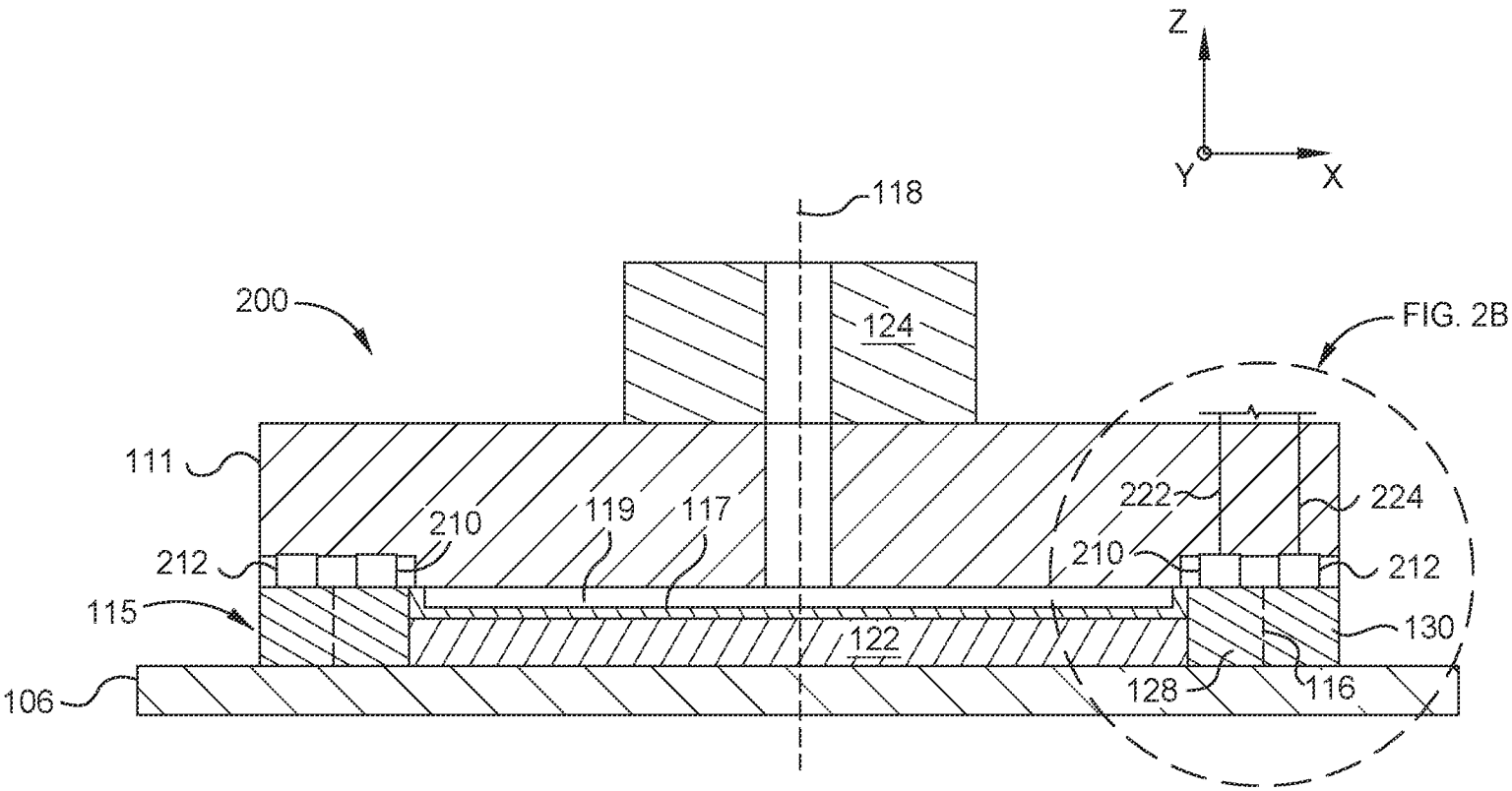
FIG. 2A is a schematic side cross-sectional view of an exemplary substrate carrier that may be used in the polishing system of FIG. 1B.
Figure 2B:
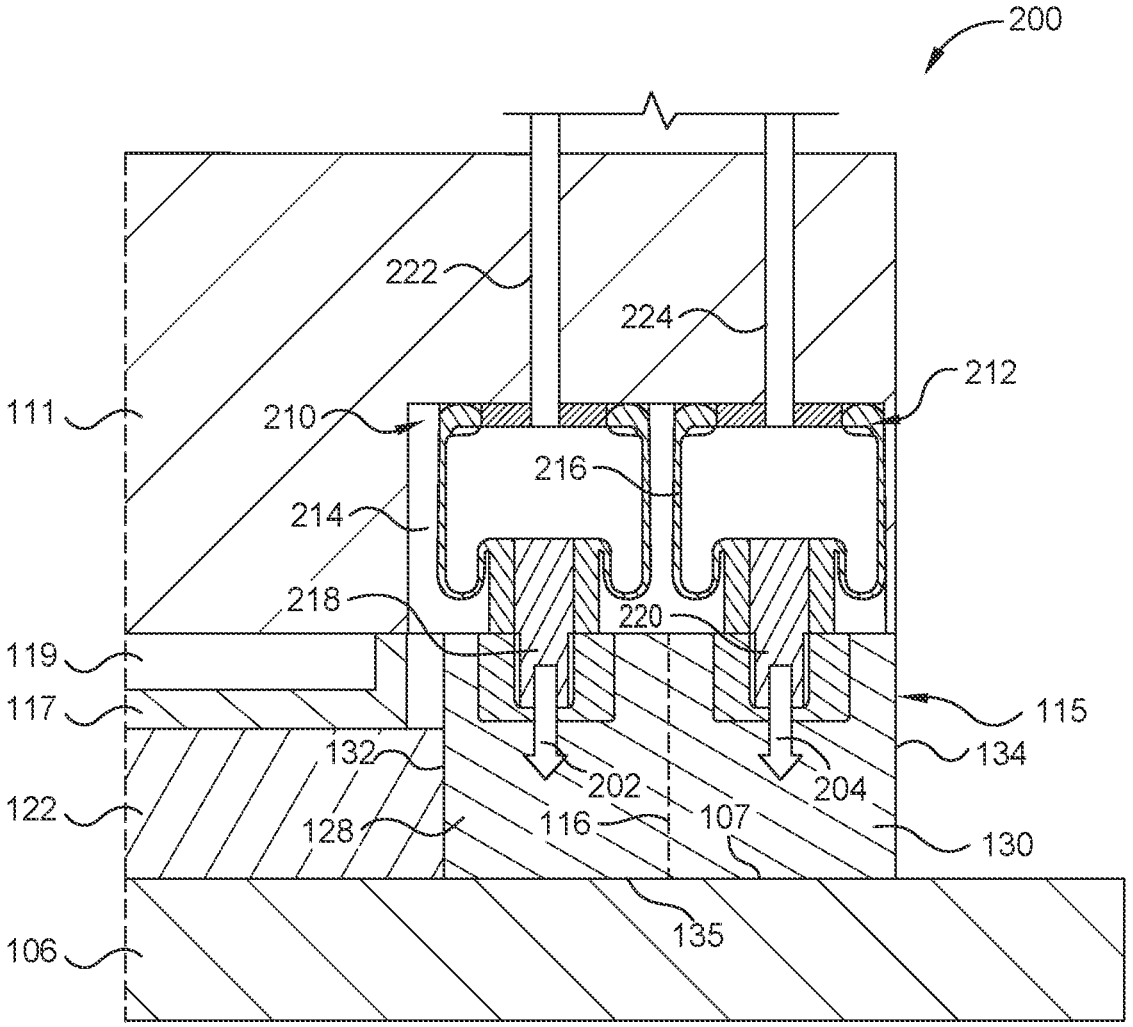
FIG. 2B is an enlarged schematic side cross-sectional view of a portion of the substrate carrier of FIG. 2A.

FIG. 2A is a schematic side cross-sectional view of an exemplary substrate carrier 200 that may be used in the polishing system 101 of FIG. 1B. FIG. 2B is an enlarged schematic side cross-sectional view of a portion of FIG. 2A illustrating a plurality of load couplings in more detail. The substrate carrier 200 is similar to the substrate carrier 110 of FIG. 1A, except where noted, and corresponding description may be incorporated herein without limitation. The retaining ring 115 is coupled to the housing 111. In operation, the retaining ring 115 is contacting the polishing pad 106 to retain the substrate 122 in the substrate carrier 110 and to apply pre-compression to the polishing pad 106. In one or more illustrated embodiments, the retaining ring 115 has an integral molded construction formed from a plastic, e.g., polyurethane (PU), polyethylene terephthalate (PET), polyether ether ketone (PEEK), polytetrafluoroethylene (PTFE), other similar materials, or combinations thereof. In some other embodiments (not shown), a lower portion of the retaining ring 115 proximate the polishing pad 106 is formed from a plastic, whereas an upper portion of the retaining ring 115 proximate the housing 111 is formed from a relatively rigid material such as a metal, e.g., stainless steel or anodized aluminum, a ceramic, a plastic, e.g., polyphenylene sulfide (PPS) or polyethylene terephthalate (PET), other similar materials, or combinations thereof. In such embodiments, the retaining ring 115 has a bonded construction.

An annular body of the retaining ring 115 includes an inner annular portion 128 and an outer annular portion 130 surrounding the inner annular portion 128. The inner annular portion 128 has an inner edge 132 facing a central axis 118 of the annular body. The outer annular portion 130 has an outer edge 134 facing opposite the inner edge 132. The inner and outer annular portions 128, 130 are concentric to one another. The inner and outer annular portions 128, 130 are defined by a line 116 positioned radially between the inner and outer edges 132, 134 of the retaining ring 115. Here, the line 116 is a centerline equally spaced between the inner and outer edges 132, 134 so that the inner and outer annular portions 128, 130 have equal width in the radial direction. In some other embodiments, the line 116 is unequally spaced between the inner and outer edges 132, 134 so that the inner and outer annular portions 128, 130 have different widths in the radial direction. The line 116 is aligned along the z-axis, e.g., vertically aligned in the direction of gravity. A bottom edge 135 of the retaining ring 115 faces the polishing pad 106 and extends between the inner and outer edges 132, 134. The bottom edge 135 is orthogonal relative to the z-axis, e.g., horizontally aligned orthogonal to the direction of gravity, being substantially parallel to a top surface 107 of the polishing pad 106. In one or more embodiments, the bottom edge 135 includes a plurality of radial grooves (not shown) for facilitating transport of polishing slurry.

Here, the inner and outer annular portions 128, 130 are integrally formed. In one or more embodiments where the inner and outer annular portions 128, 130 are integrally formed, a force applied to one of the inner or outer annular portions 128, 130 is at least partially distributed across both portions 128, 130. In some embodiments (not shown), the inner and outer annular portions 128, 130 are formed separately. In such embodiments, forces applied to respective ones of the inner and outer annular portions 128, 130 are isolated thereto. In some embodiments (not shown), the inner and outer annular portions 128, 130 are independently movable with respect to each other. In one or more embodiments, a force applied to one of the inner or outer annular portions 128, 130 is operable to generate a torsional moment in the retaining ring 115.

In some embodiments, a differential force is applied via the housing 111 of the substrate carrier 200 to the inner and outer annular portions 128, 130 such that the retaining ring 115 applies a corresponding differential force to the top surface 107 of polishing pad 106 in contact therewith. In some embodiments, the corresponding differential force is proportional to the differential force applied to the inner and outer annular portions 128, 130. In some embodiments, the differential force applied to the inner and outer annular portions 128, 130 generating a torsional moment in the annular body of the retaining ring 115 so that the bottom edge 135 is not perpendicular to the Z-axis, or tilted, relative to the x-y plane. In one or more embodiments, the tilt may be linear or curved. In one or more embodiments, the torsional moment and applied differential force depend on the torsional stiffness of the retaining ring 115. In one or more embodiments, the torsional stiffness, or torsional constant, of the retaining ring 115 may be from about 1,000 N-m/rad to about 150,000 N-m/rad. In some embodiments, a maximum deflection along the z-axis is about 1 mil or less, such as about 0.1 mil or less, alternatively from about 0.1 mil to about 1 mil, such as from about 0.1 mil to about 0.5 mil. In some embodiments, the tilt angle of the bottom edge 135 relative to the x-y plane is about 1° or less, such as about 0.1° or less. In such embodiments, an interface between the bottom edge 135 of the retaining ring 115 and the top surface 107 of the polishing pad 106 has a tilt corresponding to the torsional moment of the annular body. The torsional moment and resulting tilt of the bottom edge 135 results in a differential force being applied to the polishing pad 106.

In the embodiments of FIGS. 2A-2B, a plurality of load couplings, e.g., inner and outer load couplings 210, 212, are disposed in the housing 111. The inner and outer load couplings 210, 212 are positioned at different radial distances from the inner edge 132 of the retaining ring 115. Here, the outer load coupling 212 surrounds the inner load coupling 210. The inner and outer of load couplings 210, 212 are spaced radially from each other. In some other embodiments (not shown), the plurality of load couplings are spaced circumferentially from each other or spaced from each other in the Z direction, e.g., stacked. In some embodiments, the plurality of load couplings includes a number of load couplings equal to the number of forces being independently applied to the retaining ring 115. In some embodiments, the plurality of load couplings includes from two to five load couplings, such as three, four, or five load couplings.

Here, the inner load coupling 210 includes a bladder 214 coupled to the inner annular portion 128 of the retaining ring 115. The bladder 214 is disposed above the inner annular portion 128. Likewise, the outer load coupling 212 includes a bladder 216 coupled to the outer annular portion 130 of the retaining ring 115. The bladder 216 is disposed above the outer annular portion 130. In some embodiments, each bladder 214, 216 extends continuously around the housing 111. In one or more embodiments, a pressure area of each bladder 214, 216 may be from about 20 $in^2$ to 30 $in^2$, such as about 26 $in^2$. In one or more embodiments, a pressure range of each bladder 214, 216 may be from about 1 psi to about 6 psi. In one or more optional embodiments, each bladder 214, 216 is coupled to a respective one of the inner and outer annular portions 128, 130 by a respective fastener 218, 220. Here, each bladder 214, 216 is independently coupled to a respective pneumatic line 222, 224, where each pneumatic line 222, 224 is fluidly coupled to an upper pneumatic assembly (UPA) (not shown). The UPA is fluidly coupled to a pneumatic pressure source (not shown), e.g. a tank or pump for supplying a suitable gas such as air or $N_2$ to each of the bladders 214, 216. In one or more embodiments, the UPA is operable to supply up to 12 psi. In one or more embodiments, a pneumatic rotary feedthrough (not shown) fluidly couples the pneumatic lines 222, 224 between the polishing system 101 and the rotatable housing 111.

In some other embodiments (not shown), each bladder 214, 216 includes a plurality of arc-shaped segments each extending partially around the housing 111 (e.g., by about 30°). In such embodiments, loading of the retaining ring 115 may be biased towards a particular annular region of the retaining ring 115. For example, it may be desirable to apply a first radially differential force on the leading edge and a second radially differential force on the trailing edge of the retaining ring 115 as the polishing pad 106 and platen 102 rotate underneath the substrate carrier 200. In such embodiments, it may be desirable to utilize a plurality of linear actuators (e.g., solenoids, PZT devices, etc.) that are positioned to apply a force to the retaining ring 115 in a z-direction because pneumatic control may not be actuatable at a rate matching the rotation rate of the substrate carrier 200.

In practice, supplying pneumatic pressure to a respective one of the bladders 214, 216 increases a pressure therein. As a result of increasing the pressure in a respective one of the bladders 214, 216, a corresponding increasing force is applied to a respective one of the inner and outer annular portions 128, 130 of the retaining ring 115 either directly or indirectly, e.g., through an optional respective fastener 218, 220. In some embodiments, a force applied to each of the inner and outer annular portions 128, 130, which corresponds to the pressure in the bladder multiplied by the pressure area of the bladder, may be from about 20 lbf to about 180 lbf.

In one or more embodiments, the inner load coupling 210 is operable to apply a first downforce 202 to the inner annular portion 128. Likewise, the outer load coupling 212 is operable to apply a second downforce 204 to the outer annular portion 130. In one or more embodiments, the loading axes of the first and second downforces 202, 204 may be spaced in the radial direction by from about 0.5 inches to about 1 inch. In one or more embodiments, it may be desirable to maximize or increase the spacing between the loading axes in order to impart a maximum or increasing torsion moment, respectively, on the retaining ring 115 under the same load. In some embodiments, the first downforce 202 applied to the inner annular portion 128 is greater than the second downforce 204 applied to the outer annular portion 130. In some embodiments, the second downforce 204 is zero. In embodiments where the first downforce 202 is greater, the retaining ring 115 shifts its orientation so that the inner annular portion 128 is tilted toward the top surface 107 of the polishing pad 106 by a greater degree than the outer annular portion 130 (i.e., a positive taper). In embodiments where the first downforce 202 is greater, the corresponding force applied to the polishing pad 106 by the inner annular portion 128 is greater than the corresponding force applied to the polishing pad 106 by the outer annular portion 130. As a result, greater deflection of the polishing pad 106 occurs under the inner annular portion 128. In other words, greater deflection of the polishing pad 106 occurs at the inner edge 132 of the retaining ring 115, i.e., adjacent to an outer edge of the substrate 122, relative to the outer edge 134 of the retaining ring 115 due to the forces applied by the bladders or actuators, which creates a torsional moment.

In some other embodiments, the second downforce 204 applied to the outer annular portion 130 is greater than the first downforce 202 applied to the inner annular portion 128. In some embodiments, the first downforce 202 is zero. In embodiments where the second downforce 204 is greater, the retaining ring 115 shifts its orientation so that the outer annular portion 130 is tilted toward the top surface 107 of the polishing pad 106 by a greater degree than the inner annular portion 128 (i.e., a negative taper). In embodiments where the second downforce 204 is greater, the corresponding force applied to the polishing pad 106 by the outer annular portion 130 is greater than the corresponding force applied to the polishing pad 106 by the inner annular portion 128. As a result, greater deflection of the polishing pad 106 occurs under the outer annular portion 130. In other words, greater deflection of the polishing pad 106 occurs at the outer edge 134 of the retaining ring 115 relative to the inner edge 132 of the retaining ring 115 due to the forces applied by the bladders or actuators, which creates a torsional moment.

Beneficially, the substrate carrier 110 can control deflection of the polishing pad 106 along a radial direction through modulation of the first and second downforces 202, 204. In some embodiments, one or more additional downforces are independently applied to the retaining ring 115, such as from two to five total independently applied downforces at different radial distances, such as three, four, or five independently applied downforces. Beneficially, the substrate carrier 110 can improve substrate non-uniformity without replacement or redesign of the retaining ring 115. In some embodiments, a pre-load force is applied to the retaining ring 115 in addition to the first and second downforces 202, 204 described herein.

Figure 2C:
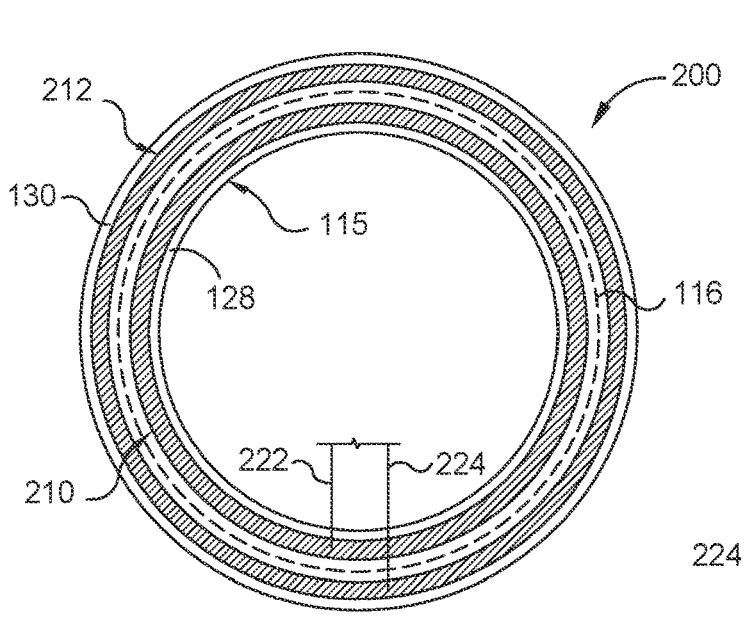
FIGS. 2C-2E are schematic top views illustrating different embodiments of the substrate carrier of FIG. 2A.
Figure 2D:
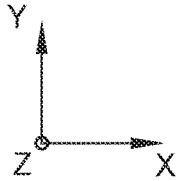
Figure 2D:
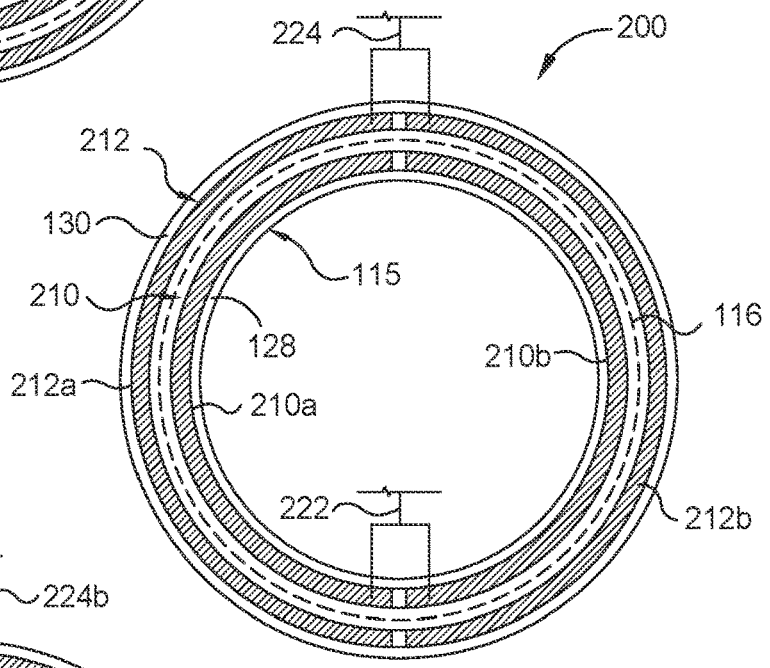
Figure 2E:
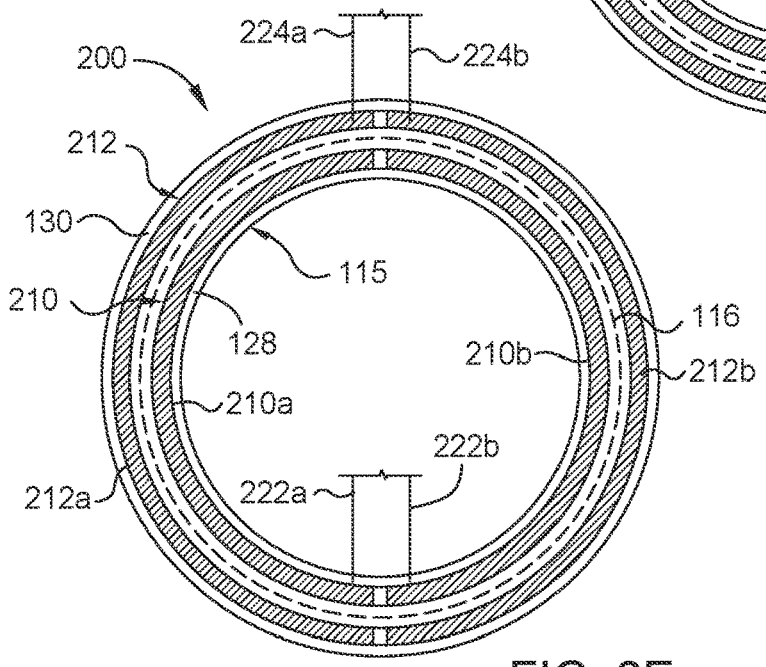

FIGS. 2C-2E are schematic top views illustrating different embodiments of the substrate carrier 200 of FIG. 2A. In FIGS. 2C-2E, certain parts of the housing 111 and certain other internal and external components of the substrate carrier 200 are omitted to more clearly show the positioning of the load couplings 210, 212 relative to the retaining ring 115. Referring to FIG. 2C, each of the inner and outer load couplings 210, 212 extends continuously around the housing 111. In such embodiments, each load coupling 210, 212 is independently coupled to a respective pneumatic line 222, 224. In such embodiments, the radially differential force and torsional moment of the retaining ring 115 are substantially uniform about the circumference thereof.

Referring to FIG. 2D, each of the inner and outer load couplings 210, 212 includes a plurality of arc-shaped segments (e.g., two arc-shaped segments) each extending partially around the housing 111 (e.g., by about 180°). In the illustrated embodiments, the inner load coupling 210 includes arc-shaped segments 210*a*, 210*b*. Likewise, the outer load coupling 212 includes arc-shaped segments 212*a*, 212*b*. In some embodiments, each of the plurality of load couplings 210, 212 includes from one to twelve arc-shaped segments, such as one, two, three, four, five, six, seven, eight, nine, ten, eleven, or twelve arc-shaped segments. Here, each of the segments in the plurality of load couplings 210, 212 are equally sized, e.g., having the same arc length. In some other embodiments, the segments have sizes different from each other. Here, the arc-shaped segments 210*a*, 210*b* of the inner load coupling 210 are fluidly coupled to the same pneumatic line 222 so that the pressure applied to each of the arc-shaped segments 210*a*, 210*b* is equal. In such embodiments, the radially differential force and torsional moment of the retaining ring 115 are substantially uniform about the circumference thereof. Likewise, the arc-shaped segments 212*a*, 212*b* of the outer load coupling 212 are fluidly coupled to the same pneumatic line 224 so that the pressure applied to each of the arc-shaped segments 212*a*, 212*b* is equal. Beneficially, the substrate carrier 200 can control deflection of the polishing pad 106 along a radial direction or within sectors of the retaining ring through modulation of the downforces applied by one or more of the arc-shaped segments 210*a*, 210*b*, 212*a*, or 212*b*.

In FIG. 2E, the arc-shaped segments 210*a*, 210*b* of the inner load coupling 210 are independently coupled to different pneumatic lines 222*a*, 222*b* so that the pressures applied to each of the arc-shaped segments 210*a*, 210*b* are independently controllable. In such embodiments, the pressures applied to each of the arc-shaped segments 210*a*, 210*b* can be the same or different. Likewise, the arc-shaped segments 212*a*, 212*b* of the outer load coupling 212 are independently coupled to different pneumatic lines 224*a*, 224*b* so that the pressures applied to each of the arc-shaped segments 212*a*, 212*b* are independently controllable. In such embodiments, the pressures applied to each of the arc-shaped segments 212*a*, 212*b* can be the same or different. In such embodiments, the radially differential force and torsional moment of the retaining ring 115 can be the same or different about the circumference thereof. Beneficially, having independent control of each of a plurality of arc-shaped segments provides more precise control of the differential force applied to the retaining ring 115, and consequently, more precise control of the differential force applied by the retaining ring 115 to the polishing pad 106.

Figure 3A:
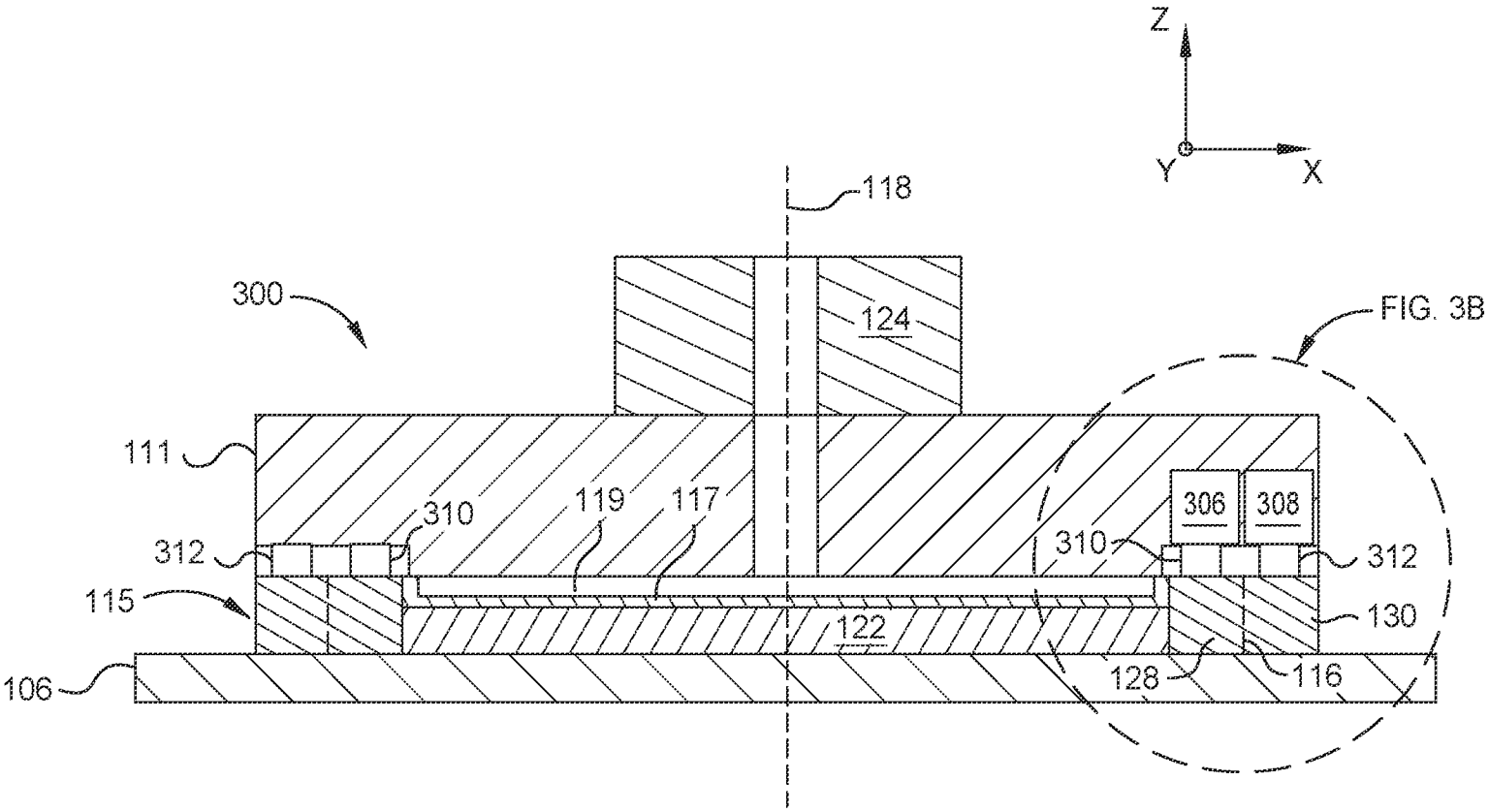
FIG. 3A is a schematic side cross-sectional view of another exemplary substrate carrier that may be used in the polishing system of FIG. 1B.
Figure 3B:
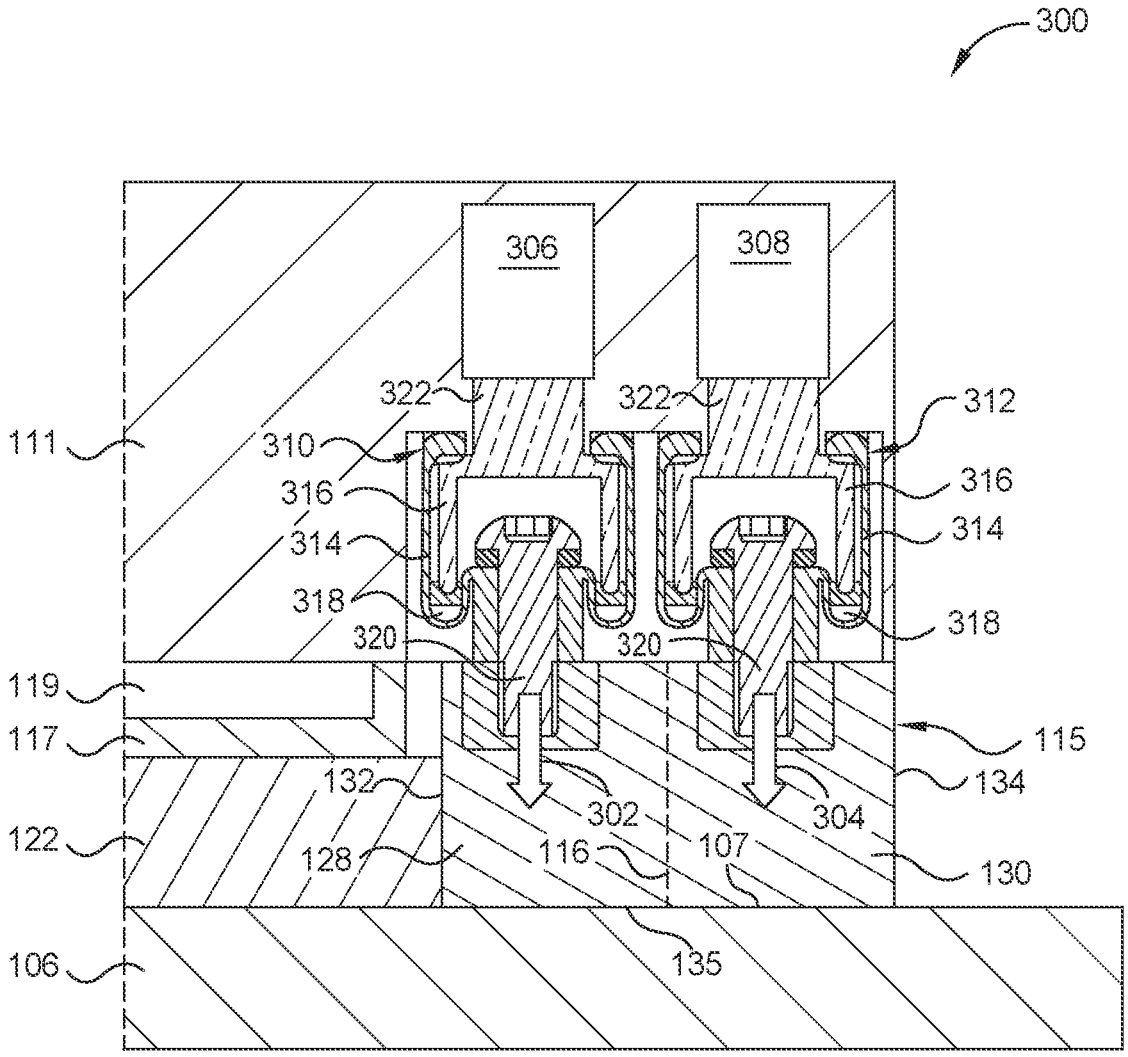
FIG. 3B is an enlarged schematic side cross-sectional view of a portion of FIG. 3A.

FIG. 3A is a schematic side view of another exemplary substrate carrier 300 that may be used in the polishing system 101 of FIG. 1B. FIG. 3B is an enlarged schematic side view of a portion of FIG. 3A illustrating a plurality of load couplings in more detail. The substrate carrier 300 is similar to the substrate carrier 200 of FIGS. 2A-2B, except where noted, and corresponding description may be incorporated herein without limitation. Referring to FIG. 3B, the inner and outer load couplings 310 include a lower clamp 314 fixedly coupled to the housing 111 and an upper clamp 316 movably coupled to the housing 111. The lower and upper clamps 314, 316 have a mating, relatively movable engagement therebetween. Here, the lower and upper clamps 314, 316 are vertically movable relative to each other. In some other embodiments, the lower and upper clamps 314, 316 have one or more additional degrees of relative motion. The lower clamp 314 includes a plurality of channels 318, here a pair, to accommodate the vertical relative movement between the lower and upper clamps 314, 316. The upper clamp 316 is further fixedly coupled to the retaining ring 115 and movable therewith. In some embodiments, the upper clamp 316 is fixedly coupled to the retaining ring 115 by one or more fasteners 320. The upper clamp 316 further includes a push rod 322 extending above the lower clamp 314.

In contrast to the substrate carrier 200 of FIGS. 2A-2B, the substrate carrier 300 includes a plurality of independent actuators, e.g., first and second actuators 306, 308. The first actuator 306 is operably coupled to the push rod 322 of the inner load coupling 310 so that linear movement of the first actuator 306 applies a force to the push rod 322 which is transferred to the retaining ring 115. In this way, the first downforce 302 is generated by the first actuator 306. Likewise, the second actuator 308 is operably coupled to the push rod 322 of the outer load coupling 312 so that linear movement of the second actuator 308 applies a force to the push rod 322 which is transferred to the retaining ring 115. In this way, the second downforce 304 is generated by the second actuator 308.

Figure 3C:
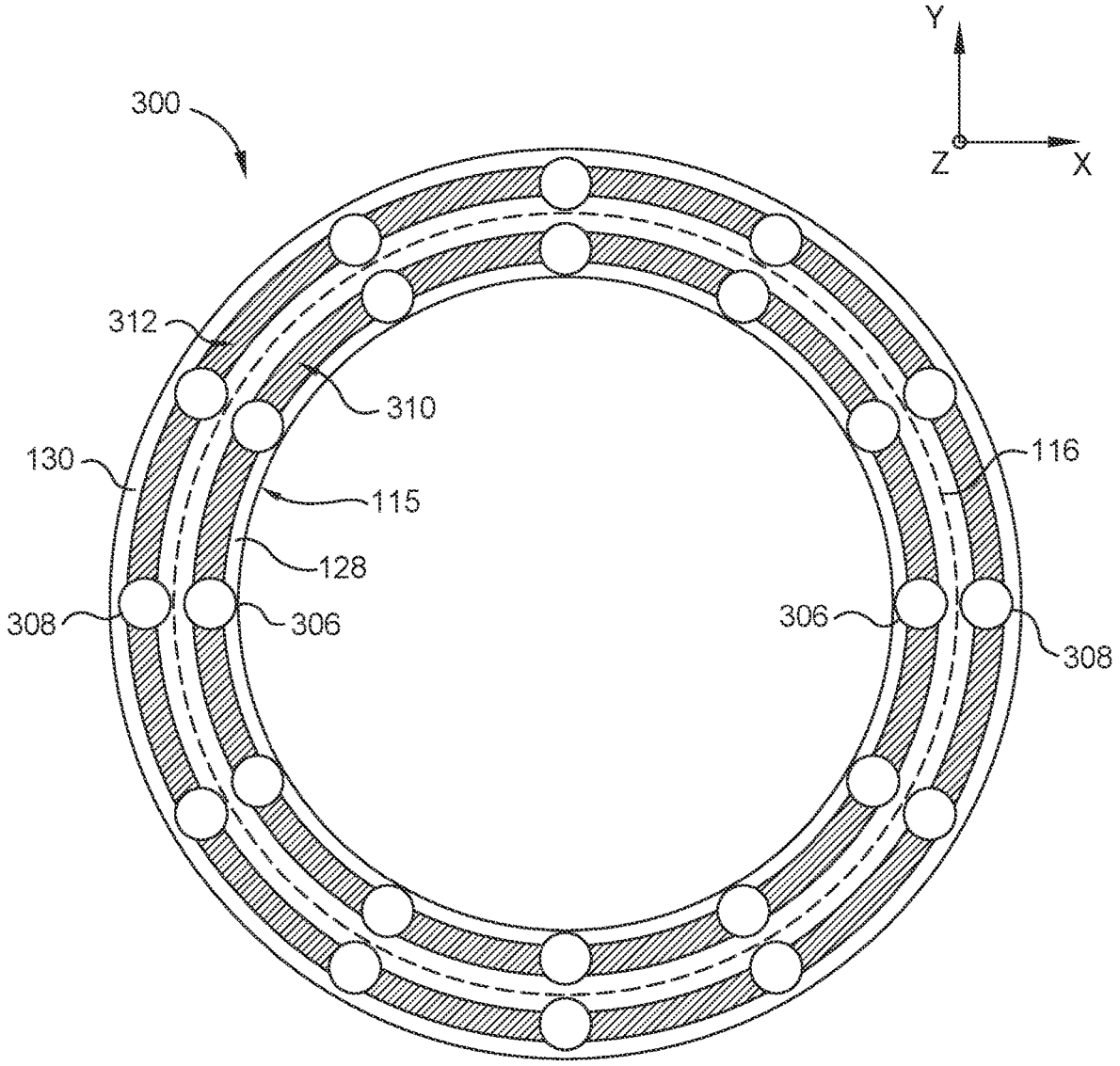
FIG. 3C is a schematic top view of the substrate carrier of FIG. 3A.

FIG. 3C is a schematic top view of the substrate carrier 300 of FIG. 3A. In FIG. 3C, certain parts of the housing 111 and certain other internal and external components of the substrate carrier 300 are omitted to more clearly show the positioning of the actuators 306, 308 and the load couplings 310, 312 relative to the retaining ring 115. Here, each of the first and second actuators 306, 308 are in circumferential alignment. As illustrated, the plurality of actuators 306, 308 are disposed in a ring around the housing 111. In such embodiments, the plurality of actuators 306, 308 are operable to apply a radially differential force to the retaining ring 115 which is substantially uniform about the circumference of the each of the inner and outer annular portions 128, 130 thereof. In one or more embodiments, the plurality of actuators 306, 308 are independently actuatable. In such embodiments, the plurality of actuators 306, 308 may be operable to apply differential forces in both the radial and circumferential directions. Here, each of the inner and outer load couplings 310, 312 extend continuously around the housing 111. In some other embodiments (not shown), each of the inner and outer load couplings 310, 312 include a plurality of arc-shaped segments aligned with each one of the plurality of actuators 306, 308. In such embodiments, pairing each of the plurality actuators 306, 308 with a respective arc-shaped segment provides precise control of the torsional moment generated in the retaining ring 115 within each of a plurality of distinct annular regions at any point in time. For example, it may be desirable to generate a first torsional moment on the leading edge and a second torsional moment on the trailing edge of the retaining ring 115 as the polishing pad 106 and platen 102 rotate underneath the substrate carrier 300. In some other embodiments (not shown), each of the inner and outer load couplings 310, 312 include a plurality of arc-shaped segments each extending partially around the housing 111 (e.g., by about 30°).

In some embodiments, as shown in FIGS. 3B-3C, the first and second actuators 306, 308 are disposed in the housing 111. In some other embodiments (not shown), the first and second actuators 306, 308 are disposed outside the housing 111 such as being coupled to the carriage arm 113 or the carriage assembly 114 (FIG. 1B). In some embodiments, the first and second actuators 306, 308 can be solenoids, pneumatic actuators, hydraulic actuators, piezo-electric actuators, voice coils, stepper motors, other linear actuators, other similar actuators, or combinations thereof.

In the embodiments illustrated in FIGS. 2A-2B and 3A-3B, the plurality of load couplings are disposed in the housing 111. In some other embodiments (not shown), the plurality of load couplings are disposed outside the housing 111 such as being coupled to the carriage arm 113 or the carriage assembly 114 (FIG. 1B). In the embodiments illustrated in FIGS. 2A-2B and 3A-3B, the plurality of load couplings are radially aligned, e.g., along the Z axis, with respective inner and outer annular portions 128, 130 of the retaining ring 115. In some other embodiments (not shown), one or more of the plurality of load couplings are not in alignment with, e.g., being radially offset from, the inner and outer annular portions 128, 130. In one or more embodiments described herein, the bottom edge 135 of the retaining ring 115 wears down during use due to contact with the polishing pad 106. In some embodiments, the wear is measured using one or more in situ sensors. In such embodiments, the radially differential force applied to the retaining ring 115 and the resulting generated torsional moment are controlled based on the measured wear of the bottom edge 135. In some other embodiments, wear of the bottom edge 135 is controlled based on a material of the retaining ring 115. For example, in one or more embodiments, respective bottom edges 135 of each of the inner and outer annular portions 128, 130 may be formed from different materials having different hardnesses and/or wear resistance. In one or more embodiments, the materials may be selected to mitigate grooving the inner edge 132 of the retaining ring 115, e.g., where the inner edge 132 and bottom edge 135 intersect.

Figure 4A:
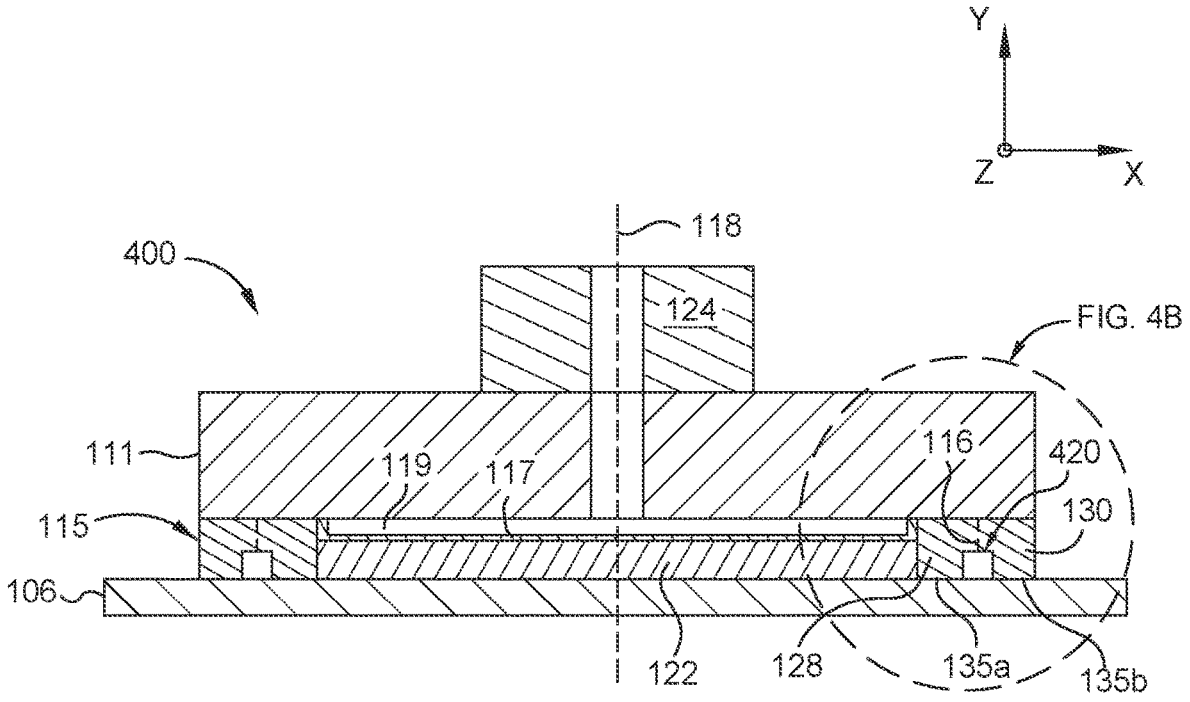
FIG. 4A is a schematic side cross-sectional view of an exemplary retaining ring that may be used with any one of the substrate carriers disclosed herein, according to one or more embodiments.
Figure 4B:
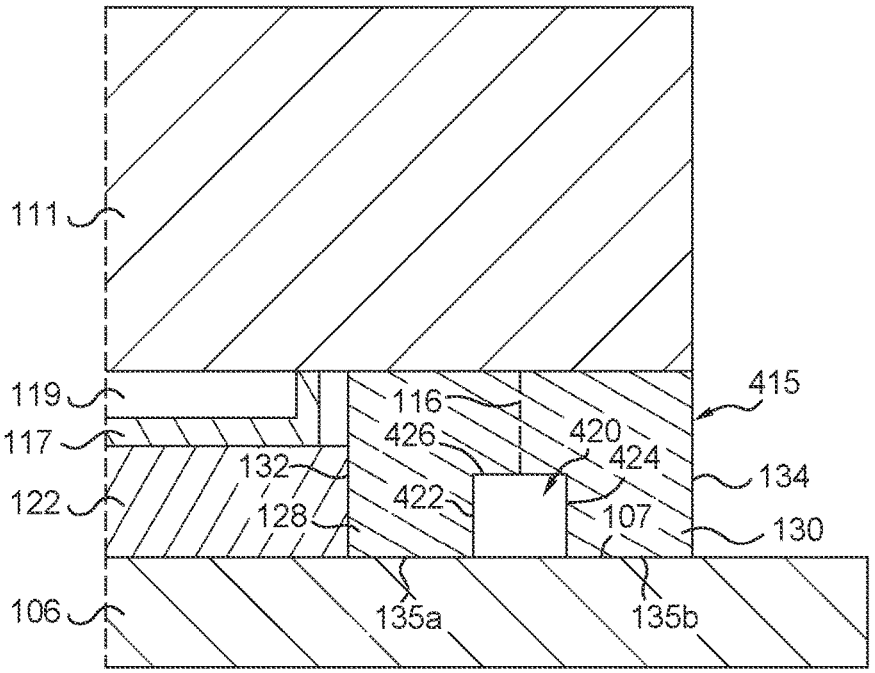
FIG. 4B is an enlarged schematic side cross-sectional view of a portion of FIG. 4A.

FIG. 4A is a schematic side view of an exemplary retaining ring 415 that may be used with any one of the substrate carriers 110, 200, 300, 400 disclosed herein. FIG. 4B is an enlarged schematic side view of a portion of FIG. 4A. The retaining ring 415 is shown in combination with an exemplary substrate carrier 400 for illustrative purposes only. The substrate carrier 400 is not particularly limited to the illustrated embodiments, and the retaining ring 415 may be combined with any one of the substrate carriers 200, 300 disclosed herein without limitation. Therefore, corresponding description of the substrate carriers 200, 300 may be incorporated herein without limitation. Referring to FIGS. 4A-4B, the retaining ring 415 has a circumferential groove 420. The circumferential groove 420 is formed in the bottom edge 135 of the retaining ring 415. In one or more embodiments, the circumferential groove 420 is a continuous annular groove around the retaining ring 415. In some other embodiments, the circumferential groove 420 consists of a plurality of arc-shaped segments. In one example, the arc-shaped segments are separated by a radially oriented groove and have an arc length relative to a central axis of the retaining ring that is between about 5 degrees and about 175 degrees in swept length. Here, the circumferential groove 420 has a square profile in cross-section. For example, in one or more illustrated embodiments, the circumferential groove 420 has inner and outer edges 422, 424 which are substantially orthogonal to the bottom edge 135. The circumferential groove 420 has a top edge 426 extending between the inner and outer edges 422, 424 where the top edge 426 is substantially parallel to the bottom edge 135. A width of the circumferential groove 420 from the inner edge 422 to the outer edge 424, that is in the radial direction, is from about 0.1 inches to about 0.5 inches. In some embodiments, a height of the circumferential groove 420 from the bottom edge 135 to the top edge 426 is from about 0.1 inches to about 0.5 inches.

In some other embodiments (not shown), the circumferential groove 420 may have a rectangular, rounded, or oval profile in cross-section. As shown in FIG. 4B, the circumferential groove 420 is symmetrically aligned with the line 116. In this configuration, the circumferential groove 420 is equally spaced between the inner and outer edges 132, 134 of the retaining ring 115 so that bottom edges 135*a*, 135*b* of the inner and outer annular portions 128, 130, respectively, have equal width in the radial direction. In some other embodiments, the circumferential groove 420 is unequally spaced between the inner and outer edges 132, 134 so that bottom edges 135*a*, 135*b* of the inner and outer annular portions 128, 130, respectively, have different widths in the radial direction. The circumferential groove 420 can create the effect of two independent retaining rings within a single integral retaining ring, e.g., the retaining ring 415, namely by forming separate bottom edges 135*a*, 135*b* for each of the inner and outer annular portions 128, 130, respectively. The circumferential groove 420 increases the torsional moment of the retaining ring 415 under the same load and improves the capability of the retaining ring 415 to apply and control differential force to the polishing pad 106 along the radial direction.

Figure 5A:
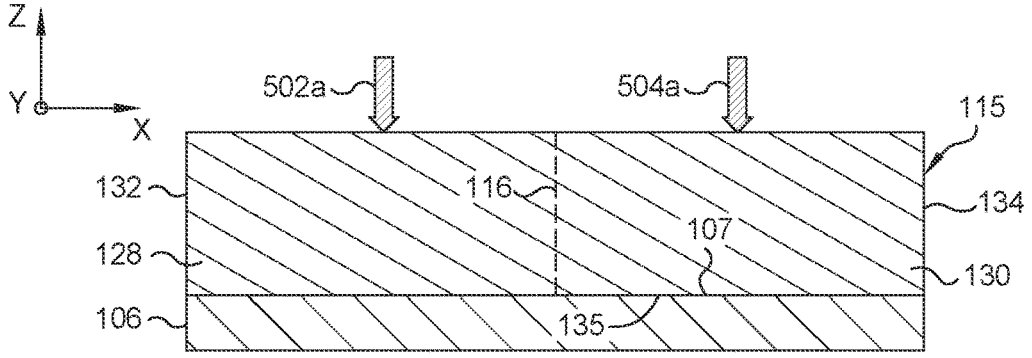
FIG. 5A is an enlarged schematic side cross-sectional view of another exemplary retaining ring that may be used with any one of the substrate carriers disclosed herein, according to one or more embodiments.
Figure 5B:
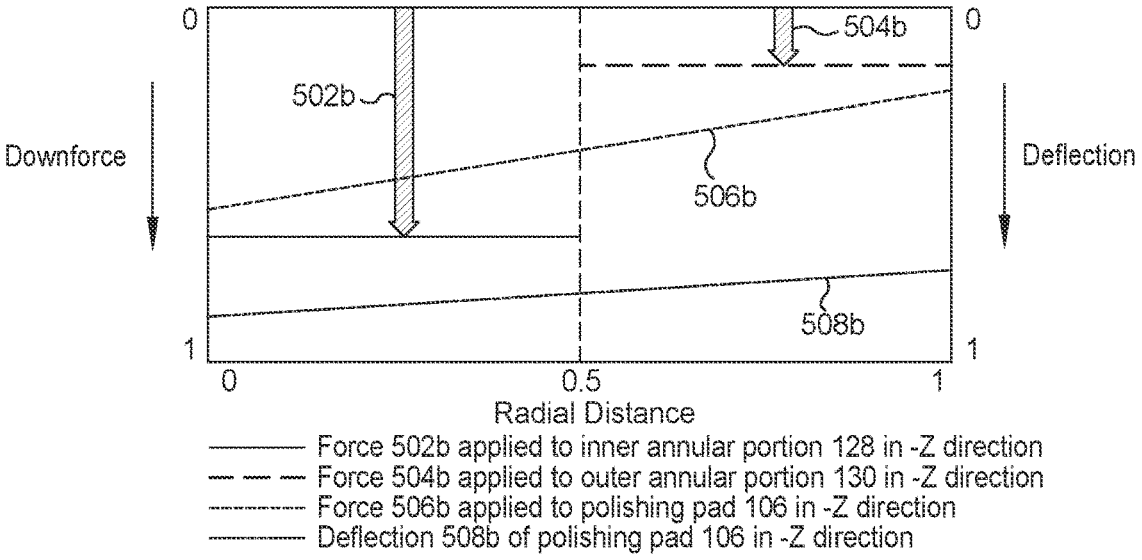
FIGS. 5B-5C are diagrams illustrating downforce/deflection as a function of radial distance from an inner edge to an outer edge of the retaining ring of FIG. 5A.
Figure 5C:
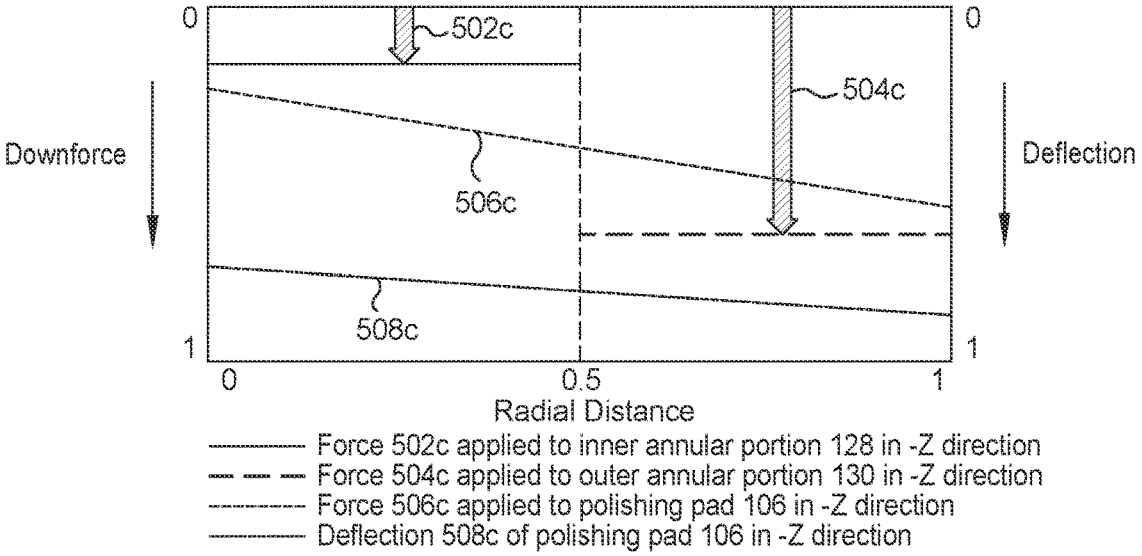

FIG. 5A is an enlarged schematic side view of another exemplary retaining ring 115 that may be used with any one of the substrate carriers 110, 200, 300, 400 disclosed herein. Here, a first downforce 502*a* is applied to the inner annular portion 128, and a second downforce 504*a* is applied to the outer annular portion 130. FIGS. 5B-5C are diagrams illustrating downforce/deflection as a function of radial distance from the inner edge 132 to the outer edge 134 of the retaining ring 115 of FIG. 5A. Each of the diagrams illustrated in FIGS. 5B-5C is aligned radially with the schematic view of the retaining ring 115 of FIG. 5A.

FIG. 5B illustrates downforce and deflection of the retaining ring 115 and the polishing pad 106, respectively, where a first downforce 502*b* is greater than a second downforce 504*b*. The first and second downforces 502*b*, 504*b* are applied to the inner and outer annular portions 128, 130, respectively, in the −Z direction, generating a torsional moment in the retaining ring 115. The torsional moment of the retaining ring 115 applies a differential pressure to the polishing pad 106 by contact between the bottom edge 135 of the retaining ring 115 and the top surface 107 of the polishing pad 106. A force 506*b* applied to the polishing pad 106 in the −Z direction increases from the outer edge 134 to the inner edge 132 of the retaining ring 115. Here the force 506*b* varies linearly. In some other embodiments, the force 506*b* varies non-linearly. As a result of the force 506*b*, a deflection 508*b* of the polishing pad 106 in the −Z direction increases from the outer edge 134 to the inner edge 132 of the retaining ring 115. Here, the deflection 508*b* of the polishing pad 106 is directly, linearly proportional to the applied force 506*b*. In some other embodiments, the applied force 506*b* and deflection 508*b* are non-linearly proportional to each other.

FIG. 5C illustrates downforce and deflection of the retaining ring 115 and the polishing pad 106, respectively, where a first downforce 502*c* is less than a second downforce 504*c*. The first and second downforces 502*c*, 504*c* are applied to the inner and outer annular portions 128, 130, respectively, in the −Z direction, generating a torsional moment in the retaining ring 115. The torsional moment of the retaining ring 115 applies a differential pressure to the polishing pad 106 by contact between the bottom edge 135 of the retaining ring 115 and the top surface 107 of the polishing pad 106. A force 506*c* applied to the polishing pad 106 in the −Z direction increases from the outer edge 134 to the inner edge 132 of the retaining ring 115. Here the force 506*c* varies linearly. In some other embodiments, the force 506*c* varies non-linearly. As a result of the force 506*c*, a deflection 508*c* of the polishing pad 106 in the −Z direction increases from the outer edge 134 to the inner edge 132 of the retaining ring 115. Here, the deflection 508*c* of the polishing pad 106 is directly, linearly proportional to the applied force 506*c*. In some other embodiments, the applied force 506*c* and deflection 508*c* are non-linearly proportional to each other.

In one or more embodiments, the system controller 136 (FIG. 1A) is operable to control a plurality of radially and/or circumferentially differential forces on a retaining ring. In one or more embodiments, the control can be based on a pre-determined polishing plan. In some embodiments, the system controller 136 is operable to independently monitor a plurality of applied forces and adjust the applied forces in real time. In some embodiments, the system controller 136 is operable to receive inputs from one or more sensors, e.g., optical sensors, to measure wafer thickness and/or wafer non-uniformity in situ. In some embodiments, sensors on or within the platen 102 sense the wafer thickness. In some embodiments, the system controller 136 is operable to output signals to control each of the plurality load couplings or actuators based on the in situ measurements. The system controller 136 is a general use computer that is used to control one or more components found in the processing system(s) disclosed herein. The system controller 136 is generally designed to facilitate the control and automation of one or more of the processing sequences disclosed herein and typically includes a central processing unit (CPU) (not shown), memory (not shown), and support circuits (or I/O) (not shown). Software instructions and data can be coded and stored within the memory (e.g., non-transitory computer readable medium) for instructing the CPU. A program (or computer instructions) readable by the processing unit within the system controller determines which tasks are performable in the processing system. For example, the non-transitory computer readable medium includes a program which when executed by the processing unit are configured to perform one or more of the methods described herein. Preferably, the program includes code to perform tasks relating to monitoring, execution and control of the movement, applied forces/loads, and/or other various process recipe variables and various CMP process recipe steps being performed. In summary, aspects of the present disclosure at least enable precise control of radially and/or circumferentially differential forces applied to a retaining ring, thereby enabling precise control of the compression of the polishing pad in contact therewith. As a result, embodiments of the present disclosure enable improved control over polishing pad deflection and resultant mitigation of substrate profile issues.

While the foregoing is directed to embodiments of the present disclosure, other and further embodiments of the disclosure may be devised without departing from the basic scope thereof, and the scope thereof is determined by the claims that follow.

What is claimed is:

1. A substrate carrier configured to be attached to a polishing system for polishing a substrate, the substrate carrier comprising:

a housing including a plurality of load couplings; and a retaining ring coupled to the housing, the retaining ring being monolithic and including:

an annular body having a central axis;

an inner edge facing the central axis of the annular body, the inner edge having a diameter configured to surround the substrate; and an outer edge opposite the inner edge, wherein the plurality of load couplings contact the retaining ring at different radial distances measured from the central axis, and wherein the plurality of load couplings are configured to apply a radially differential force to the retaining ring.

2. The substrate carrier of claim 1, wherein the plurality of load couplings comprise:

an inner load coupling radially positioned over an inner annular portion of the annular body and configured to apply a first downforce thereto; and an outer load coupling surrounding the inner load coupling, the outer load coupling radially positioned over an outer annular portion of the annular body and configured to apply a second downforce thereto different from the first downforce.

3. The substrate carrier of claim 2, wherein a difference between the first and second downforces is configured to generate a torsional moment in the annular body.

4. The substrate carrier of claim 1, wherein a radially differential force applied to the retaining ring causes a polishing pad in contact therewith to deflect away from the substrate carrier by a distance proportional to the applied force.

5. The substrate carrier of claim 1, wherein each of the plurality of load couplings comprises a bladder fluidly coupled to a pneumatic pressure source.

6. The substrate carrier of claim 1, wherein each of the plurality of load couplings comprises a push rod in contact with an actuator disposed in the housing.

7. The substrate carrier of claim 6, wherein the actuator is a first actuator of a plurality of actuators, and wherein the plurality of actuators include at least one of solenoids, pneumatic actuators, hydraulic actuators, piezo-electric actuators, voice coils, stepper motors, other linear actuators, other similar actuators, or combinations thereof.

8. The substrate carrier of claim 6, wherein each of the plurality of load couplings further comprises:

a lower clamp fixedly coupled to the housing; and an upper clamp fixedly coupled to the retaining ring and movable therewith, wherein the lower and upper clamps have a mating, relatively movable engagement therebetween, and wherein the push rod is formed on the upper clamp.

9. The substrate carrier of claim 1, wherein each of the plurality of load couplings extends continuously around the substrate carrier.

10. The substrate carrier of claim 1, wherein one or more of the plurality of load couplings includes a plurality of arc-shaped segments, and wherein each of the arc-shaped segments is independently actuatable.

11. A method for polishing a substrate disposed in a substrate carrier, the method comprising:

moving the substrate carrier relative to a polishing pad, wherein a retaining ring of the substrate carrier is monolithic and contacts the polishing pad during the process of moving the substrate carrier; and during the process of moving the substrate carrier, applying a radially differential force to the retaining ring using a plurality of load couplings, wherein the plurality of load couplings are spaced apart from each other at different radial distances.

12. The method of claim 11, wherein applying the radially differential force comprises:

applying a first downforce to an inner annular portion of the retaining ring via an inner load coupling radially positioned thereover; and applying a second downforce to an outer annular portion of the retaining ring via an outer load coupling radially positioned thereover, the outer load coupling surrounding the inner load coupling.

13. The method of claim 12, wherein each of the inner and outer load couplings comprise a bladder fluidly coupled to a pneumatic pressure source, and wherein the application of each of the first and second downforces is proportional to a respective pressure supplied to each bladder.

14. The method of claim 12, wherein each of the inner and outer load couplings comprise a push rod in contact with an actuator disposed in a housing of the substrate carrier, and wherein the application of each of the first and second downforces is proportional to a respective force applied by each actuator.

15. The method of claim 11, wherein applying the radially differential force generates a torsional moment in the retaining ring.

16. The method of claim 15, wherein the torsional moment of the retaining ring applies a radially differential force to the polishing pad.

17. A polishing system, comprising:

a polishing pad; and a substrate carrier configured to press a substrate against the polishing pad, the substrate carrier comprising:

a housing including a plurality of load couplings; and a retaining ring coupled to the housing, the retaining ring being monolithic and including:

an annular body having a central axis;

an inner edge facing the central axis of the annular body, the inner edge having a diameter configured to surround the substrate; and an outer edge opposite the inner edge, wherein the plurality of load couplings contact the retaining ring at different radial distances measured from the central axis, and wherein the plurality of load couplings are configured to apply a radially differential force to the retaining ring.

18. The polishing system of claim 17, wherein the plurality of load couplings comprise:

an inner load coupling radially positioned over an inner annular portion of the retaining ring and configured to apply a first downforce thereto; and an outer load coupling surrounding the inner load coupling, the outer load coupling radially positioned over an outer annular portion of the annular body and configured to apply a second downforce thereto different from the first downforce.

19. The polishing system of claim 18, wherein a difference between the first and second downforces is configured to generate a torsional moment in the annular body.

20. The polishing system of claim 17, wherein a radially differential force applied to the retaining ring causes the polishing pad in contact therewith to deflect away from the substrate carrier by a distance proportional to the applied force.

* * * * *